United States Patent [19]

Janzen

[11] 4,106,714

[45] Aug. 15, 1978

[54] WIRE REELING APPARATUS

[76] Inventor: Harlo W. Janzen, Rte. 2, Box 74, Balko, Okla. 73931

[21] Appl. No.: 816,267

[22] Filed: Jul. 18, 1977

[51] Int. Cl.[2] ..... B65H 75/00; B65H 79/00

[52] U.S. Cl. ..... 242/54 R; 242/47; 242/85

[58] Field of Search ..... 242/25 R, 54 R, 47, 242/85, 86, 86.1, 86.2, 86.3, 86.4, 86.5 R, 86.52, 86.6, 86.61, 86.62, 86.63, 86.64, 86.7, 86.8, 95

[56] References Cited

U.S. PATENT DOCUMENTS

| | | | |
|---|---|---|---|
| 1,131,103 | 3/1915 | Arduser | 242/86.62 |
| 1,409,328 | 3/1922 | Wolfe | 242/54 R X |
| 1,809,490 | 6/1931 | Rippe | 242/86.62 |
| 2,203,435 | 6/1940 | Kempe | 242/86.8 X |
| 2,475,762 | 7/1949 | Toland | 242/86.8 |
| 2,494,383 | 1/1950 | Foran | 242/86.8 |
| 2,650,771 | 9/1953 | Marion | 242/54 R |
| 2,711,293 | 6/1955 | Hanson | 242/25 R X |
| 3,503,565 | 3/1970 | Durkee et al. | 242/25 R |
| 4,012,001 | 3/1977 | Knox | 242/54 R |
| 4,046,331 | 9/1977 | Decker, Sr. | 242/54 R |

*Primary Examiner*—Stanley N. Gilreath
*Attorney, Agent, or Firm*—William R. Laney

[57] ABSTRACT

An apparatus for reeling up and storing wire including at least one drive roller, a reel shaft and a driving member extending between and drivingly interconnecting the drive rollers and reel shaft. A control handle is provided and is movably connected to a brake bar for brakingly engaging the driving member, and alternatively, for guiding wire being reeled upon a reel supported on the reel shaft for rotation therewith.

27 Claims, 8 Drawing Figures

WIRE REELING APPARATUS

BACKGROUND OF THE INVENTION

1. Field of the Invention

This invention relates to devices which can be employed to wind or coil upon a drum type reel, a substantial length of wire, or other elongated flexible member.

2. Brief Discussion of the Prior Art

A number of types of devices have previously been proposed for reeling up or for unreeling great lengths of wire, such as barbed wire, or smooth, relatively small diameter wire, such as electric fence wire. Other types of wire also are frequently stored upon large reels or drums, and means must be provided for winding as well as unwinding the wire at different times. Manual winding devices are, of course, time-consuming and strenuous to operate, and from a practical point of view, cannot be utilized to wind up great lengths of wire.

Some devices which have previously been provided contemplate the mounting of a spool upon a shaft or post mounted on a truck, with a motor or manual means then provided for rotating this spool to wind up fencing wire in the field.

For the purpose of avoiding the necessity to provide a reeling motor, or the manual effort necessary to reel up wire on a drum, it has also been proposed to connect a reel to the hub of an automobile wheel and, after jacking up the car, to run the automobile in order to cause the wheel and reel to undergo rotation, and in the course of doing so, to wind up the wire. This structure, of course, has the disadvantage of requiring some time to install or place in proper winding position on the hub of the wheel, entails the dangerous and strenuous procedure of jacking up the vehicle, and has other attendant disadvantages which largely offset the advantage of allowing the reel to be motor driven as the wire is wound up.

GENERAL DESCRIPTION OF THE PRESENT INVENTION

The present invention comprises a wire reeling apparatus which can be used for reeling up long lengths of wire upon a large diameter reel, and which does not require the use of a specially provided motor and is not manually operated. The wire reeling apparatus of the invention can be operated by the use of power developed by a conventional automobile without the necessity of in any way altering the automobile, or placing any portion of the apparatus in fixed position on the automobile or jacking up the automobile.

Broadly described, the wire reeling apparatus of the invention comprises at least one and preferably two drive rollers which are rotatably mounted in a ramped framework to permit the wheel of an automobile to be brought into frictional driving engagement with the drive rollers merely by driving the automobile across the ramp framework until the rear wheel of the automobile rests upon the drive roller.

Supported above the ramped framework and above the drive rollers is a large driven wheel which preferably is in the form of a pulley. A suitable flexible driving member, such as a belt, is then used for interconnecting the drive rollers with the pulley to drive the pulley in rotation when the drive belt is tensioned. Secured to the center of the pulley is an elongated shaft which projects rotatably through a hub supported on the ramped framework. The elongated shaft is dimensioned to receive, and to be rotatably and selectively interlocked with, a drum or reel having a bore through the center thereof to receive the shaft. For the purpose of winding wire upon the reel, the reel is placed in position and locked to the shaft which, of course, is drivingly connected to the pulley.

The wire reeling apparatus further includes a unique control mechanism which permits wire being taken up on the rotating reel to be guided and straightened as it approaches and is wound upon the reel, and which further enables the drive belt to be selectively tensioned or slackened, and finally, to be braked, all through the use of one common control shaft.

An important object of the present invention is to provide a wire reeling apparatus which is mechanically strong and can be operated by the use of motive power supplied from a conventional automobile.

A further object of the invention is to provide a wire reeling apparatus which can be driven from the rotating powered rear wheel of an automobile without the necessity for attaching any part of the wire reeling apparatus to the wheel, or to any part of the vehicle upon which the wheel is located.

A further object of the invention is to provide a wire reeling apparatus which can be used to form a neat roll of fence wire or the like in which successive turns or convolutions of the wire are in an axially contiguous position on the roll over the length of the reel before the next radially outer layer of turns is commenced.

A further object of the invention is to provide a wire reeling apparatus which can be easily powered by association with a driven wheel of a conventional automobile and, concurrently, can be controlled in its rate of reeling and in the manner in which the wire is fed to the reel by a single control shaft which is manually operated.

Additional objects and advantages of the invention will become apparent as the following detailed description of preferred embodiments of the invention is considered in conjunction with the accompanying drawings which illustrate such preferred embodiments.

GENERAL DESCRIPTION OF THE DRAWINGS

DETAILED DESCRIPTION OF PREFERRED EMBODIMENTS OF THE INVENTION

Figure 1:
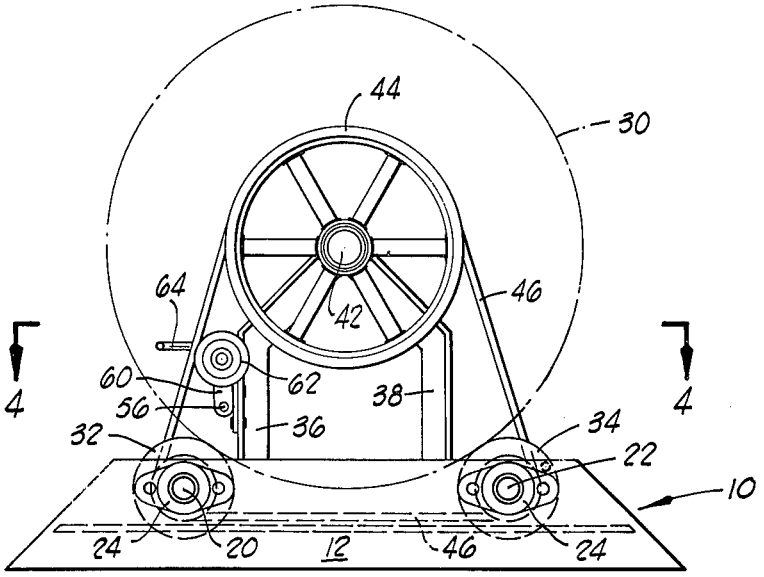
FIG. 1 is a side elevation view of the wire reeling apparatus of the invention as it appears when viewed from one side thereof and facing an automobile tire used for driving the apparatus. The automobile tire position is shown in dashed lines.

In FIG. 1 of the drawings, a base or frame 10 is provided in the apparatus of the invention and includes a pair of spaced, substantially parallel, trapezoidally shaped side plates 12 and 14. At the opposite ends of the side plates 12 and 14, the tapered edges of these side plates are aligned and are secured to a pair of inclined ramp plates 16 and 18.

Figure 2:
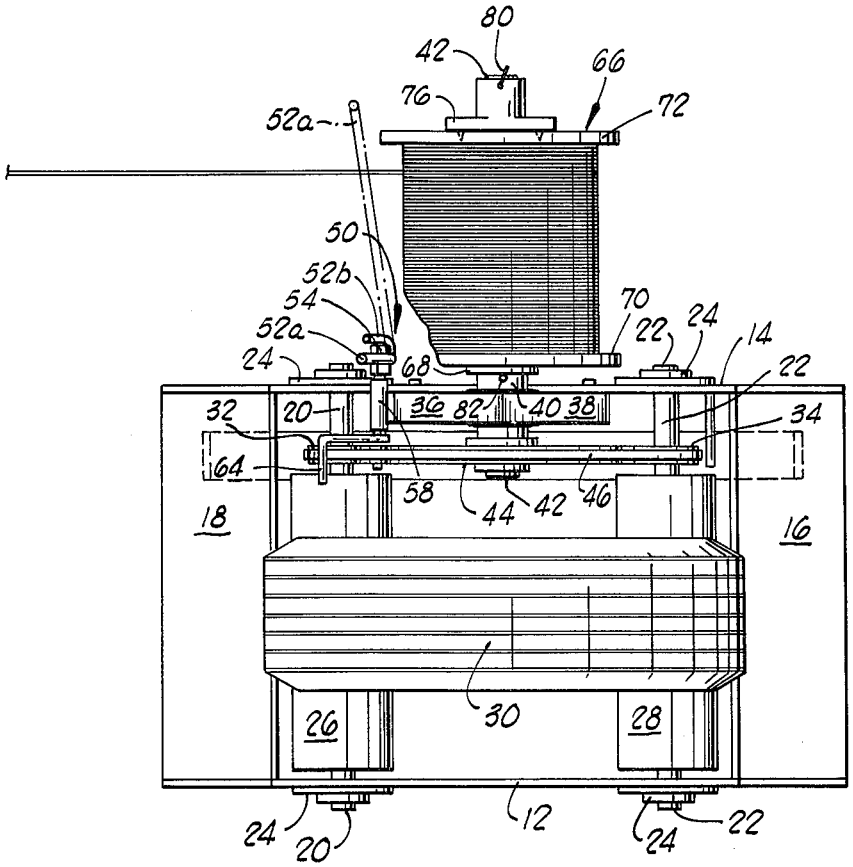
FIG. 2 is a plan view of the apparatus illustrated in FIG. 1, but depicting the automobile tire in full lines and further depicting a reel spool or drum in position on the apparatus as it appears when wire is being reeled thereon.

A pair of spaced, substantially parallel shafts 20 and 22 extend between the side plates 12 and 14, with the opposite end portions projecting through these plates and received in journal elements 24. A drive roller 26 is keyed to the shaft 20 for rotation therewith, and a substantially parallel drive roller 28 is keyed to the shaft 22 for rotation therewith. The spacing between the drive rollers 26 and 28 is such that these rollers will engage the outer peripheral portions of an automobile tire 30 in the manner illustrated in the drawings. It will further be observed that the width of the base 10, as measured between the side walls 12 and 14, is such that when the tire is positioned over and in contact with the drive rollers 26 and 28, the axle of the wheel carrying the tire, and extending to the automobile differential, is predominantly to one side of the base 10, and only a small portion of the automobile is actually over the base. The ramp plates 16 and 18, however, are sufficiently wide to enable the automobile tire to be easily located over the central portion of the drive rollers 26 and 28 as shown in FIG. 2.

For purposes of the following discussion, the side plate 12 of the base 10 may be considered the inner side plate, in the sense that it is adjacent or slightly under the automobile carrying the tire 30 in driving engagement with the drive rollers 26 and 28, and the side plate 14 may be considered the outer side plate in that it is most distal with respect to the wheel of the automobile itself. Positioned between the drive roller 26 and the outer side plate 14, and keyed to the shaft 20 for rotation therewith, is a drive pulley 32. Similarly, a second drive pulley 34 is positioned between the end of the drive roller 28 and the outer side plate 14, and is keyed to the shaft 22 for rotation therewith.

A pair of upright supporting members 36 and 38 are bolted or otherwise suitably secured at one of their ends to the inner side of the outer side plate 14 at a location spaced between the shafts 20 and 22. The supporting members 36 and 38 project upwardly from this side plate in the manner illustrated in FIGS. 1 and 3. The upper end portions of the upright supporting members 36 and 38 are bent into a convergent relationship, and are joined at their upper ends to provide support to a large hub 40. Projecting through, and rotatably journaled in, the hub 40 is an elongated reel shaft 42. The major portion of the reel shaft 42 projects outwardly from the outer side plate 14 and provides a situs for mounting a reel spool as hereinafter described. The inner portion of the reel shaft 42 has keyed thereto for rotation with the reel shaft, a large peripherally grooved driven pulley 44. For the purpose of driving the pulley in rotation at certain times during the operation of the reel apparatus, an elongated endless flexible belt 46 is extended around the pulley 44 and around the idler pulleys 32 and 34 which are keyed to the shafts 20 and 22, respectively.

Figure 3:
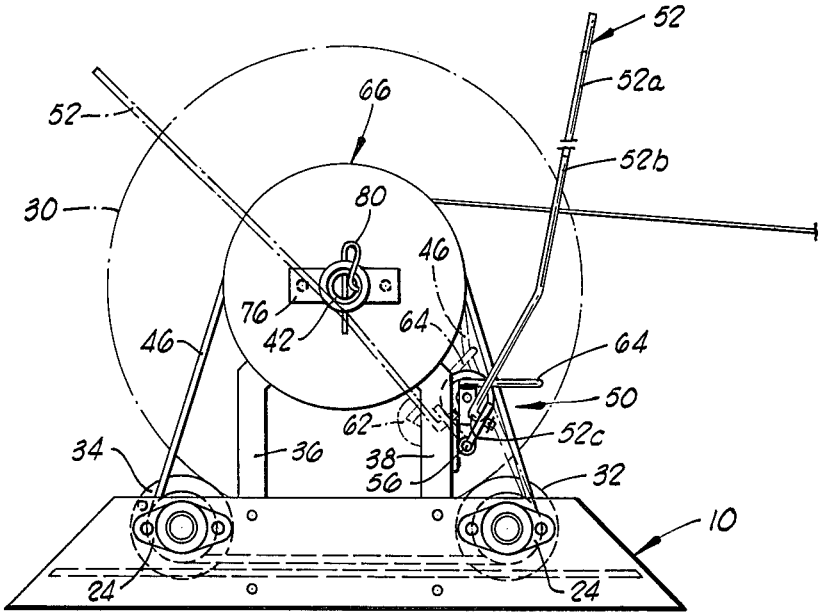
FIG. 3 is a side elevation view of the wire reeling apparatus of the invention as it appears when viewed from the opposite side of the apparatus from that shown in FIG. 1.
Figure 4:
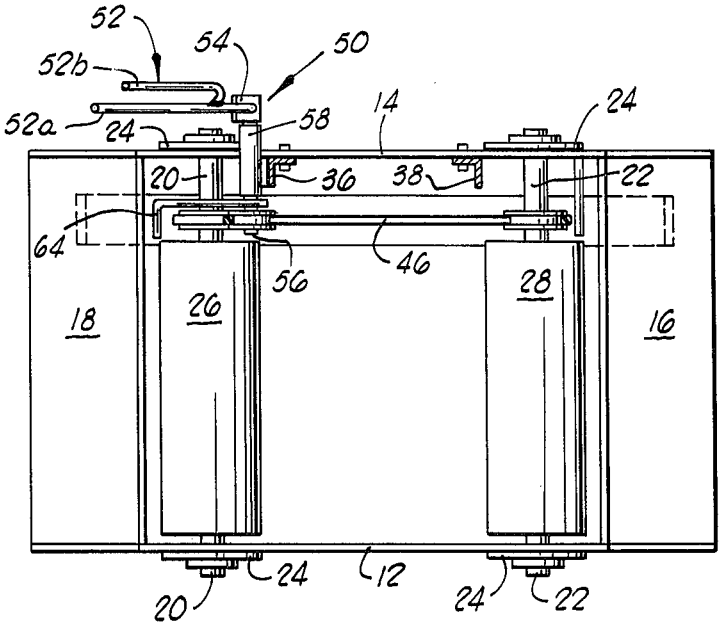
FIG. 4 is a sectional view taken along line 4—4 of FIG. 1.
Figure 5:
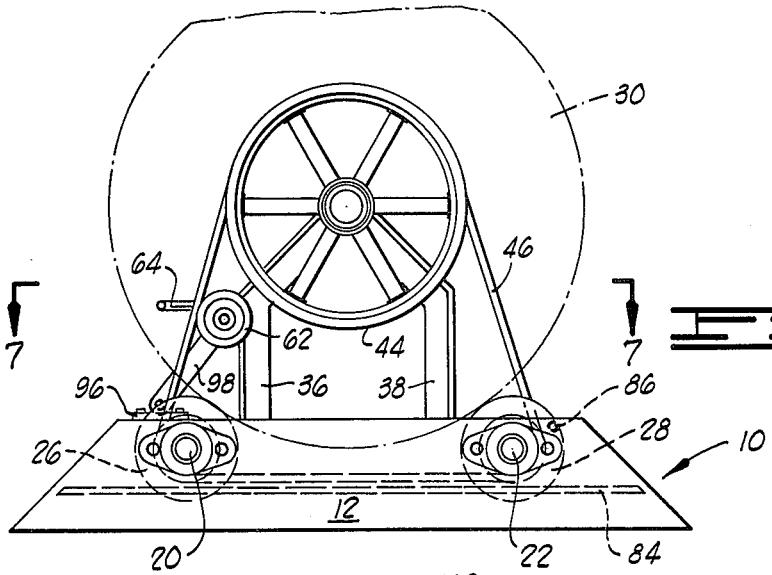
FIG. 5 is a side elevation view of a modified embodiment of the wire reeling apparatus of the invention.

A control mechanism is provided in the wire reeling apparatus of the invention and is designated generally in the drawings by reference numeral 50. The control mechanism 50 includes an elongated control handle 52 which is preferably bifurcated at a point along its length to include the parallel portions **52*a* and 52*b* illustrated in FIG. 4 of the drawings. It will be noted that the portion 52*a* of the control handle 52 is substantially longer than the portion 52*b* thereof. At its lower end, the control handle 52 has a turned-over end portion 52*c* which is bent through an angle of 90° and is projected through an aperture formed in a plate 54. The control handle 52 thus can be pivoted about the axis of the end portion 52*c* so that it can swing or swivel from side to side in a manner and for a purpose hereinafter described in detail. The plate 54 is welded to an outer end of a generally cylindrical pivot rod 56 which extends rotatably through a sleeve 58 which is mounted in any suitable way to a flanged side of the upright member 36 as best illustrated in FIGS. 3 and 4. The pivot rod 56 is thus free to pivot within the sleeve 58 and, in undergoing such pivotation, to cause pivotal movement of the plate 54** about the axis of the pivot rod.

Welded to the inner end of the pivot rod 56 and projecting upwardly therefrom is a bracket plate 60. The bracket plate 60 rotatably supports at its upper end, a tensioning pulley 62. The tensioning pulley 62 is positioned on the bracket plate 60 so that it is aligned with, and can engage, the flexible drive belt 46 at a time when the tensioning pulley is moved against the drive belt as hereinafter described. Also welded to the upper end of the bracket plate 60 is an L-shaped brake bar 64 (see FIGS. 2 and 4). The brake bar 64 includes a first leg extending substantially parallel to the plane of the bracket plate 60 and a second leg extending at right angles to the first leg and across the plane of the drive belt 46. When the brake bar 64 is moved to the right as viewed in FIGS. 1 and 2, it will bear against the drive belt 46. This braking position of the brake bar 64 is illustrated in dashed lines in FIG. 3.

For the purpose of winding up and storing an elongated wire or other flexible member, a reel spool of generally cylindrical configuration, and designated generally by reference numeral 66, is placed on the reel shaft 42 on the opposite side of the hub 40 from the pulley 44. The hub 40 carries a stop flange 68, and one of two end plates 70 or 72 of the reel spool 66 will abut the stop flange 68 when the reel spool is placed in position on the reel shaft 42. The reel spool 66, in addition to the end plates 70 and 72, includes, of course, a central cylindrical core (not visible) upon which the wire, cable or other flexible member is wound. The reel spool 66 also further includes a locking hub 76 which is secured to the end plate 72, and is bored to rotatably receive the reel shaft 42. The outer end of the reel shaft 42 carries a diametric passageway through the center thereof, and is positioned so that this passageway can be aligned with an aperture formed through the locking hub 76. A locking pin 80 is then passed through the aperture and passageway to interlock the hub 76 with the reel shaft 42, and thus assure rotation of the reel spool 66 with the reel shaft. This interlock is shown in FIG. 3.

It should be further pointed out that a similar locking capability is made to characterize the hub 40 and the reel shaft 42. Thus, as shown in FIG. 2, an aperture 82 is provided in the top side of the hub 40 immediately over the reel shaft 42, and is positioned for alignment with a mating aperture or passageway formed in the reel shaft 42 in a location directly therebelow. During the reeling operation, no interlock or engagement is provided between the hub 40 and the reel shaft 42. Subsequently, however, when it is desired to drive the automobile off the base 10 and, in doing so, to brake the drive rollers 26 and 28 to permit this to be accomplished, a pin is dropped through the aperture 82 into an aligned aperture or passageway in the reel shaft 42 so that the reel shaft is then locked against rotation, and thus the pulley 34 is also prevented from rotating.

Operation

In the operation and use of the wire reeling apparatus of the invention, an automobile is initially driven adjacent the apparatus so that one of the rear wheels passes up over one of the ramp plates 16 or 18, and comes to rest upon the drive rollers 26 and 28 in the position illustrated in FIG. 2. At this time, a locking pin is preferably extended through the aperture 82 in the hub 40 to lockingly engage a registering aperture or recess formed in the reel shaft 42. This prevents rotation of the shaft 42 and the pulley 34 carried thereon and the frictional drag of the drive belt 46 on the pulleys 32 and 34 thus tends to keep these pulleys stationary until the surface 30 of the tire of the automobile is in contact with each of the drive rollers 26 and 28.

When the automobile is so positioned with its tire resting upon the drive rollers 26 and 28, the pin is removed from the aperture 82 in the hub 40 to release the shaft 42 for rotation. A reel spool 66 is then slid on the outer end of the reel shaft 42 until the end plate 70 thereof abuts the flange 68 at the outer side of the hub 40. A pin 80 is then inserted through the aperture formed in the locking hub 76 at the outer side of the reel spool 66 so as to interlock the locking hub with the shaft when the pin passes into the aligned passageway formed in the outer end portion of the shaft. The reel spool 66 is thereby rotatably keyed to the reel shaft 42, and will undergo rotation therewith. During these operations, the control handle 52 is preferably in about the position illustrated in FIG. 3, or even in a slightly more vertically extending position. When the control handle 52 is in this position, the tensioning pulley 62 will be spaced slightly to the left of the drive belt 46, as shown in FIG. 3, and the brake bar 64 will be positioned to the right of the drive belt 46.

After the reel spool 66 is locked to the reel shaft 42 in the manner described, the control handle 52 is pulled to the right from the position illustrated in FIG. 3. This causes the pivot rod 56 to undergo rotation in its sleeve 58 and thereby swing the bracket plate 60 in a pivoting movement to the left as viewed in FIG. 1. This movement of the bracket plate 60 causes a concomitant swinging movement of the tensioning pulley 62 so that this pulley is brought into engagement with the drive belt 46. Continued movement of the control arm 52 toward the right, as that structure is viewed in FIG. 3, causes the tensioning pulley to tension the drive belt 46, and thus assure driving engagement between the pulleys 32 and 34 and the pulley 44.

The engine of the automobile is then started and is placed in one of the forward gears or in the reverse gear. Which gear is selected will be dependent upon whether the wire or other flexible member is to be wound up from a direction to the left of the reel spool 66 as viewed in FIG. 2, or to the right of the reel spool. In any event, starting of the engine of the automobile and placement of the vehicle in gear will cause the wheel which carries the tire in contact with the drive rollers 26 and 28 to undergo rotation. The other rear wheel of the vehicle is, of course, in contact with the ground and the wheel which carries the tire in contact with the drive rollers 26 and 28 is caused to undergo rotation through the action of the vehicle differential gear.

As the drive rollers 26 and 28, in frictional contact with the tire 30, are caused to rotate, the pulleys 32 and 34 are rotated, and the pulley 44 on the end of the reel shaft 42 is also rotated. This causes rotation of the reel shaft 42, and with it the reel spool 66. Accordingly, the wire can now be wound upon the reel shaft in the manner illustrated in FIG. 2. It is assumed, of course, that prior to commencing actual rotation of the reel spool 66, a free end of the wire has been stopped off at some point on the periphery of the cylindrical core portion of the reel.

As the reel spool 66 is rotated and the wire or other flexible member commences to be wound thereon, the manner in which the wire is laid up on the reel spool can be closely controlled by the use of the control handle 52. Thus, prior to commencement of the winding up of the wire on the reel spool 66, the span of the wire is caused to extend between the portions **52*a* and 52*b* of the control handle so that this can function as a guide to the wire during the reeling operation. It will be recalled that the control handle 52 can be pivoted about the axis of the end portion 52*c* thereof so that it can be moved, for example, from the position in which it is shown in full lines in FIG. 2 over to a position shown in dashed lines in that same figure. This type of movement will be carried out in order to direct and guide the wire being reeled upon the reel spool from a starting position, at which it is relatively near to the end plate 70, to a position outwardly from this at which it is wound upon the reel spool at a location close to the end plate 72. After one lay-up of convolutions of the wire is completed over the axial dimension of the reel spool between the end plates 70 and 72, the direction of the lay-up is reversed to cause the wire to be wound up in succeeding contiguous axial convolutions in an inward direction from the end plate 72 toward the end plate 70. This procedure is repeated back and forth along the core of the reel spool 66** until the reel is completely filled in a symmetric manner, or until the total length of the wire is wound upon the reel.

It should be pointed out that one of the advantages of the control mechanism 50 provided in the present invention is that it is possible to attain concurrent close control over both the manner in which the wire is wound upon the reel spool 66 and the speed at which the wire is wound upon the reel spool. Thus, by moving the control handle 52 slightly toward the left as the control handle is viewed in FIG. 3, some of the tension in the drive belt 46 can be relieved as the tensioning pulley 62 is moved to a position where a slightly lesser force is exerted upon the drive belt. This will permit some slippage on the pulleys to occur and the speed of the reel to be decreased. In fact, it is preferable to have a sufficient amount of slack in the drive belt 46 at times when it is not positively tensioned by the tensioning pulley 62 that the belt will slip very easily on the pulleys 44, 32 and 34, and very little drive will be imparted by the latter pulleys to the pulley 44.

It should also be pointed out that the control mechanism 50 of the wire reeling apparatus of the invention, and particularly the manner in which the control handle 52 is constructed, in addition to affording the wire guiding function described, enables automatic assurance against passage of kinked or obstructed wire onto the reel spool 66. Thus, if a span of the wire which contains or has formed therein a large kink, in being wound up upon the reel spool 66, comes into contact with one or both of the portions 52*a* or 52*b* of the control handle 52, this contact will, in many instances, remove the kink or straighten the wire, and where this does not occur, the effect of contact of the kink with the portions 52*a* and 52*b* as the wire is wound upon the reel spool 66 is to cause the control handle 52 to be pulled toward the left as it is viewed in FIG. 3, and thus to automatically release the tensioning pulley 62 from tensioning engagement with the drive belt 46. The reel spool 66 is thus relieved from positive drive at this time, and, except for its momentum, will be slowed or stopped. Thus, the kink is not wound into the convolutions of wire going onto the reel spool. Instead, the reel spool may be easily stopped until the kink is straightened out or removed.

After the wire is completely wound on the reel spool 66, the completed reel may be removed from the reel shaft 42 by extracting the pin 80 from the aperture in the hub 76 and aligned passageway in the reel shaft 42. This is, of course, accomplished after the engine of the automobile has been turned off, or placed in neutral gear, and rotation of the reel shaft 42 has been stopped. After the completed reel has been removed from the reel shaft 42, or even before this time, the automobile may be driven forward so that the wheel carrying the tire 30 moves off the drive rollers 26 and 28, across the ramp plate 16 or 18 and back into contact with the ground. If the drive rollers 26 and 28 were free to rotate when it were undertaken to drive the automobile off the base 10, difficulty would be encountered due to the ability of the wheel on the drive rollers 26 and 28 to spin freely and the inability of the differential of the car to deliver any driving torque to the other wheel of the vehicle in contact with the ground. This situation is prevented by braking the drive rollers 26 and 28 against rotation at this time.

Braking of the drive rollers 26 and 28 is effected as follows. First, a locking pin is dropped through the aperture 82 in the hub 40 and into an aligned or mating aperture or recess formed in the reel shaft 42. This locks the hub 40 to the reel shaft 42 and thus prevents rotation of the reel shaft 42 and the driven pulley 44 carried thereby. Braking action is now obtained by shifting the control handle 52 from the full line position illustrated in FIG. 3 to the dashed line position there shown. This position can be easily attained after the full reel has been removed from the reel shaft 42 by pivoting the control handle 52 slightly outwardly away from the side plate 14 in the manner shown in FIG. 2, and then pivoting it from that location toward the right as it is viewed in FIG. 2. This will bring it to the location shown in FIG. 3 of the drawings. This movement of the control handle 52 causes a rotational movement of the pivot rod 56 and a concurrent movement of the bracket plate 60. In such movement, the bracket plate 60 moves in a clockwise direction as it is viewed in FIG. 1. This, of course, disengages the tensioning pulley 62 from the drive belt 46, but also has the effect of bringing the brake bar 64 into braking contact with the drive belt 46. This position is clearly illustrated in dashed lines in FIG. 3 where it will be noted that the brake bar 62 has engaged the drive belt 46 and has tensioned it in a reverse direction so as to pull it tightly about the immobilized pulley 44. The pulley 44 cannot undergo rotation at this time, of course, by reason of its being keyed to the reel shaft 52, which shaft is pinned to the hub 40 to prevent its rotation. Since the pulleys 32 and 34 cannot undergo rotation, neither can the shafts 20 and 22, respectively, to which they are keyed. This in turn means that the drive rollers 26 and 28 are effectively braked. The wheel 30 of the vehicle which is supported by these drive rollers can now move off the base 10 without difficulty.

A modified embodiment of the wire reeling apparatus of the invention is illustrated in FIGS. 5–8. Since a number of the structural elements of the embodiment here illustrated correspond in form and function to those previously illustrated and described in referring to FIGS. 1–4, identical reference numerals have been used to identify identical structural elements where they are used and appear in FIGS. 5–8.

Figure 6:
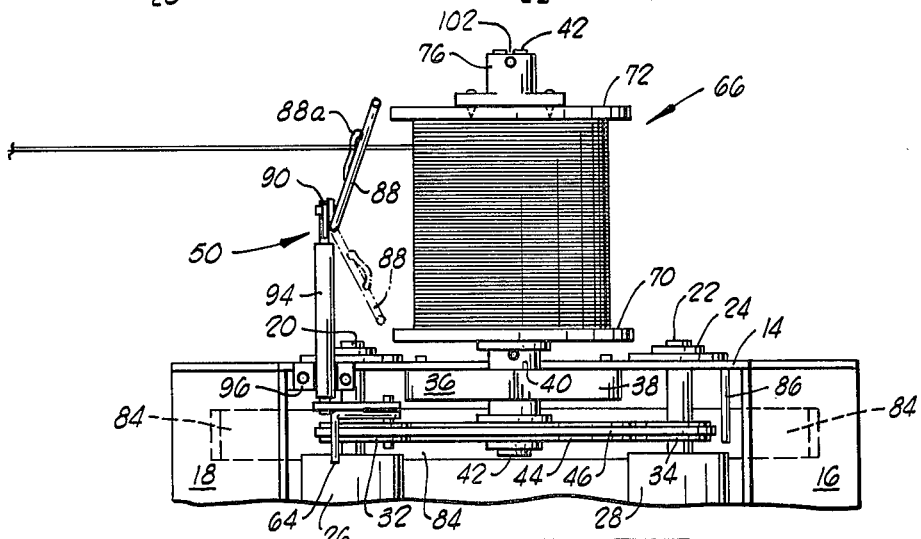
FIG. 6 is a partial plan view of the modified embodiment of the invention depicted in FIG. 5.
Figure 7:
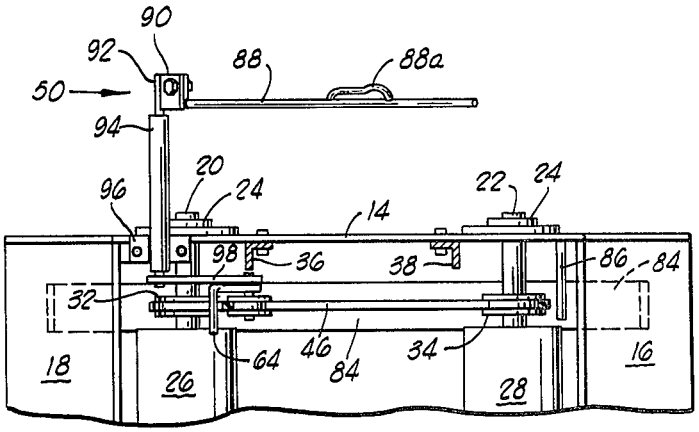
FIG. 7 is a sectional view taken in the horizontal plane along line 7—7 of FIG. 5 with a portion of the apparatus broken away and removed for clarity of illustration.

In the embodiment of the invention shown in FIGS. 5–8, an elongated metal strap 84 is welded at its opposite ends to the ramp plates 16 and 18, and is positioned at a horizontal level such that it extends immediately beneath the lower run of the belt 46 where the belt passes between the driven pulleys 32 and 34. The strap 84, as thus positioned, prevents the belt from sagging at times when the belt is released from its driven status in relation to the drive pulleys by removing the tensioning pulley 62 from tensioning contact with the belt. For the same purpose, a relatively short piece of a small diameter rod 86 is welded to the inner side of the side plate 14, and projects inwardly into close proximity to the belt 46 at a location where the belt 46 extends around the drive pulley 34 as illustrated in FIG. 7. This shaft or rod also aids in preventing sagging of the belt at a time when it is slacked.

The modified embodiment of the invention of FIGS. 5–8 further includes a modified control mechanism 50 employed in this form of the wire reeling apparatus. The control mechanism 50 includes an elongated handle 88 which carries a loop or eye 88*a* welded to one side thereof, and functioning to guide and control the movement of a wire being reeled on a reel drum as the handle 88 is manipulated. The handle 88 includes a lower end portion which is secured by any suitable means to a plate 90. The plate 90 is welded to the periphery of the outer end of a generally cylindrical pivot rod 92 which extends rotatably through an elongated tubular member or sleeve 94. The sleeve 94 is welded to a plate 96 which is secured by suitable brackets to the corner formed between the upper edge of the ramp plate 18 and the end of the top edge of the side plate 14. It will be noted in referring to FIG. 6 that the sleeve 94 in this embodiment of the invention projects outwardly from the side plate 14 by a distance such that the end of the rod 92 is at about the mid-portion of the reel spool 66.

At its inner end inside the side plate 14, the pivot rod 92 is secured to the lower end of an elongated bracket plate 98 which supports a tensioning pulley 62 of the type hereinbefore described, at its upper end. Also welded to the upper end of the bracket plate 98 is an L-shaped brake bar 64 as previously described.

Figure 8:
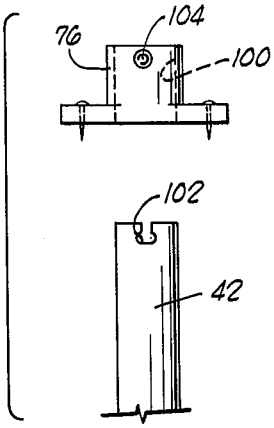
FIG. 8 illustrates separated structural elements used for keying a locking hub to a reel shaft in the embodiment of the invention illustrated in FIGS. 5–7.

As shown particularly in FIGS. 6 and 8, the modified embodiment of the invention shown in FIGS. 5–8 further contemplates the usage of a locking hub 76 which includes a bore 100 which is diametrically dimensioned to receive the outer end of the reel shaft 42. The reel shaft 42 is, in this form of the invention, slotted with a T-shaped slot 102 in the manner illustrated in FIG. 8. A riveted shear pin 104 is extended diametrically through the bore 100 in the hub 76 in a position such that when the hub is secured to the outer end plate 72 of the reel spool 66, the riveted shear pin 104 will pass into, and will engage, the T-shaped slot 102 to interlock the reel spool 66 with the reel shaft 42 for mutual rotation.

The operation and use of the embodiment shown in FIGS. 5–8 are substantially the same as those which characterize the embodiment shown in FIGS. 1–4 and hereinbefore described.

Although preferred embodiments of the invention have been herein described in order to clearly demonstrate the manner in which the principles underlying the invention are employed and enter into the advantageous and highly useful operation of the wire reeling apparatus, it will be understood that various changes and innovations in the illustrated and described structure can be effected without departure from these basic principles. Changes and innovations of this type are therefore deemed to be circumscribed by the spirit and scope of the invention, except as the same may be necessarily limited by the appended claims or reasonable equivalents thereof.

What is claimed is:

1. An apparatus for reeling up wire comprising:
at least one drive roller;
a reel shaft adapted to support a wire reel for rotation therewith;
a flexible driving member interconnecting the drive roller and reel shaft;
means for selectively preventing rotation of said reel shaft, and
control handle means including:
brake means selectively engageable with said flexible driving member upon pivotation of said control handle in one direction; and
tensioning means for tensioning said flexible member upon pivotation of said control handle means in a second direction.

2. Apparatus as defined in claim 1 wherein said control handle means further includes means for guiding a wire bi-directionally along the axis of said reel shaft upon pivotation of said handle means in a third direction.

3. Apparatus for reeling up wire as defined in claim 1 and further characterized as including a base rotatably supporting a plurality of said rollers in substantially horizontal position for rotation about horizontal axes and including ramps on opposite sides of said rollers facilitating driving the wheel of an automobile up onto said rollers.

4. Apparatus for reeling up wire as defined in claim 1 wherein said flexible drive member is an endless belt, and said brake means is a bar frictionally engageable with said endless belt.

5. Apparatus for reeling up wire as defined in claim 1 wherein said flexible drive member is an endless belt and said tensioning means is a tensioning pulley engageable with said belt to tension the belt to a driving status.

6. Apparatus for reeling up wire as defined in claim 1 and further characterized as including means for selectively locking the reel to the reel shaft.

7. Apparatus for reeling up wire as defined in claim 6 wherein said flexible drive member is an endless belt and said tensioning means is a tensioning pulley engageable with said belt to tension the belt to a driving status.

8. Apparatus for reeling up wire as defined in claim 7 wherein said brake means is a bar frictionally engageable with said endless belt.

9. Apparatus for reeling up wire as defined in claim 8 wherein said control handle means further includes means for guiding a wire bi-directionally along the axis of said reel shaft upon pivotation of said handle means in a third direction.

10. Apparatus for reeling up wire as defined in claim 9 and further characterized as including a base rotatably supporting a plurality said rollers in substantially horizontal position for rotation about horizontal axes and including ramps on opposite sides of said rollers facilitating driving the wheel of an automobile up onto said rollers.

11. Apparatus for reeling up wire as defined in claim 10 and further characterized as including means rotatably supporting said reel shaft above said base.

12. Apparatus for reeling up wire as defined in claim 2 wherein said wire guiding means comprises a bifurcated handle having a pair of parallel portions.

13. Apparatus for reeling up wire as defined in claim 11 wherein said control handle means comprises a bifurcated handle having a pair of parallel portions.

14. Apparatus for reeling up wire as defined in claim 13 wherein said control handle means is further characterized in including means supporting said handle on said base for pivotation about a horizontal axis and for pivotation in a plane containing said horizontal axis of pivotation.

15. Wire reeling apparatus comprising:
a reel spool for receiving the wire;
a reel shaft projecting axially through the reel spool;
means rotatably supporting the reel shaft;
means for selectively interlocking the reel spool to the reel shaft;
means for selectively interlocking said supporting means to said reel shaft;
means for rotatably supporting a tire of an automobile wheel;
means drivingly interconnecting said last-mentioned supporting means to said reel shaft; and
braking means for braking said interconnecting means.

16. Wire reeling apparatus as defined in claim 15 wherein said means for rotatably supporting a tire of an automobile comprises a pair of rollers supported for rotation about spaced, substantially parallel axes;
and said means for drivingly interconnecting said tire supporting means to said reel shaft comprises:
first and second drive pulleys connected to said rollers for rotation therewith;
a driven pulley connected to said reel shaft for rotation therewith; and
a flexible drive belt drivingly interconnecting said drive pulleys and said driven pulley.

17. Wire reeling apparatus as defined in claim 15 wherein said braking means comprises:
a handle; and
a brake bar connected to said handle and positioned for frictional engagement with said interconnecting means when said handle is moved.

18. Wire reeling apparatus as defined in claim 17 and further characterized as including base means rotatably supporting said tire supporting means and having said handle pivotally mounted thereon.

19. Wire reeling apparatus as defined in claim 18 wherein said handle is bifurcated to facilitate guiding a wire extended through the bifurcation to said reel spool.

20. Wire reeling apparatus as defined in claim 19 wherein said means for rotatably supporting a tire of an automobile comprises a pair of rollers supported for rotation about spaced, substantially parallel axes;

and said means for drivingly interconnecting said tire supporting means to said reel shaft comprises:

first and second drive pulleys connected to said rollers for rotation therewith;

a driven pulley connected to said reel shaft for rotation therewith; and a flexible drive belt drivingly interconnecting said drive pulleys and said drive pulley.

21. Wire reeling apparatus as defined in claim 20 wherein said braking means comprises:

a handle; and a brake bar connected to said handle and positioned for frictional engagement with said interconnecting means when said handle is moved.

22. Apparatus for rotatably driving a wire reel from an automobile wheel comprising:

a base including ramp means to permit one wheel of an automobile to be driven to the upper side of said base;

a roller rotatably mounted in said base and rotatably engageable with an automobile wheel for rotation thereby;

a reel shaft;

means rotatably supporting said reel shaft above said base;

a flexible drive member interconnecting said roller with said reel shaft;

means for mounting a reel spool on said reel shaft; and means for selectively braking said roller.

23. Wire reeling apparatus as defined in claim 22 wherein said means rotatably supporting said reel shaft above said base comprises:

upright supporting means projecting upwardly from said base; and a hub mounted on the upper end of said upright supporting means and rotatably journalling the reel shaft.

24. Wire reeling apparatus as defined in claim 23 wherein said means for selectively braking said roller includes means for selectively pinning said hub to said reel shaft to prevent rotation of the reel shaft in the hub.

25. Wire reeling apparatus as defined in claim 22 wherein said means for mounting a reel spool on said reel shaft comprises hub means mutually engageable with said reel shaft and a reel spool coaxially mounted therearound.

26. Wire reeling apparatus comprising:

means rotatable by contact with an automobile tire during the free, off-ground rotation thereof;

a wire reel spool;

means for drivingy interconnecting said wire reel spool to said rotatable means; and manual control means including:

means for selectively making and breaking the driving interconnection of said rotatable means to said wire reel spool; and means for braking the rotation of said rotatable means.

27. Wire reeling apparatus as defined in claim 26 wherein said means for selectively making and breaking the driving interconnection comprises:

a flexible drive belt;

means frictionally engageable by said drive belt when said drive belt is tensioned and connected to said rotatable means for rotation therewith;

means connected to said wire reel for rotation with the wire reel about a common axis and frictionally engageable by said drive belt when said drive belt is tensioned; and a tensioning pulley movably mounted in said apparatus for selective tensioning engagement with said belt.

* * * * *